US005887589A

United States Patent [19]

Hogan

[11] Patent Number: 5,887,589

[45] Date of Patent: Mar. 30, 1999

[54] SKELETAL REALIGNMENT SYSTEM

[76] Inventor: Arthur W. Hogan, c/o Apachie Palms R.V. Park 1836 E. Apachie Blvd., Unit 29, Tempe, Ariz. 85281

[21] Appl. No.: 986,455

[22] Filed: Dec. 8, 1997

[51] Int. Cl.[6] ..... A61G 15/00

[52] U.S. Cl. ..... 128/845; 128/846; 5/634

[58] Field of Search ..... 128/845, 846, 128/882; 5/630–652, 620, 621, 624

[56] References Cited

U.S. PATENT DOCUMENTS

| | | | |
|---|---|---|---|
| 2,314,080 | 3/1943 | Dine | 128/845 |
| 3,452,372 | 7/1969 | Emery | 5/634 |
| 3,853,121 | 12/1974 | Mizrachy | 128/882 |
| 3,931,653 | 1/1976 | Bien | 5/634 |
| 4,594,999 | 6/1986 | Nesbitt | 128/870 |

*Primary Examiner*—Michael A. Brown
*Attorney, Agent, or Firm*—Albert O. Cota

[57] ABSTRACT

A skeletal realignment system (10) which is specifically designed to alleviate many of the back aches and pains that are a direct result of a skeletal misalignment. The system (10) consists of a first implement (12) and an identical second implement (12A). To use the system (10), the two implements are positioned side-by-side on a flat surface, such as a floor mat (74), with one of the implements rotated 180 degrees from the other. The back of a person is then positioned over the implements (12, 12A) and a short exercise is performed until the back is realigned at which time the person carefully rises to a standing position.

12 Claims, 2 Drawing Sheets

SKELETAL REALIGNMENT SYSTEM

TECHNICAL FIELD

The invention pertains to the general field of passive back alignment implements and more particularly to a skeletal alignment system that utilizes a pair of implements that when properly positioned against the back, aid in the realignment of the skeletal system.

BACKGROUND ART

Amongst all people a primary source of pain and/or discomfort originates from skeletal problems. Particularly in the neck and back regions of a person's body. Skeletal problems of this type can effect people who do manual labor and those whose jobs simply require them to sit at a desk for the majority of their time. Even individuals who take precautions to avoid neck and back problems can be afflicted because of the aging process. Serious injury to the back or neck can even occur from a minor accident. once such an injury has occurred or a person begins to experience discomfort or pain, it is highly unlikely that the pain will just "go away".

Most of the time, an injured individual will have to seek some type of professional help, such as from a chiropractor. It is not at all uncommon for people to see a chiropractor on a regular basis even though no obvious injury has occurred. Because chiropractors are relatively expensive other people will rely on a massage. A massage generally provides a good "temporary fix" but rarely can it alleviate a problem permanently.

A severe neck and back pain will cause a person to have great difficulty functioning if they just leave their problem alone to fix itself. This is why it is obviously necessary to provide a means by which an average person, with no specialized training, can administer some type of relief for skeletal problems. A device that would allow an individual to remedy a skeletal mis-alignment would be beneficial for the individual user as well as the medical community. By being able to treat themselves at home, patients would not need to use valuable time that a doctor could be dedicating to more serious problems.

A search of the prior art did not disclose any patents that read directly on the claims of the instant invention, however the following U.S. patents are considered related:

| Pat. No. | INVENTOR | ISSUED |
|---|---|---|
| 5,575,295 | Khalsa et al | 19 November 1996 |
| 5,528,783 | Kunz et al | 25 June 1996 |
| 5,387,186 | Edland | 16 July 1995 |

The U.S. Pat. No. 5,575,295 patent discloses a method and apparatus for restoring spinal cervical curvature. A patient will lie on his back on a surface with his neck at the C3/C6 vertebra positioned in a groove formed in the top of a block supported in an upright position on the surface. The width of the groove is greater than the width of the patient's neck, and the thickness of the block's top surface is generally in the range of ½ inch to 3 inches. The patient remains in this position for several minutes and the treatment is repeated preferably three times a day for a period of several months.

The U.S. Pat. No. 5,528,783 patent discloses a device for the positioning and support of the head or the head and torso of a person in a spine or reclined position. This device consists of a wedge-shaped inflatable air bladder, a source of pressurized air, and air hose and valves for the controlled inflation and deflation of the air bladder. There is also a sheet of resilient material extending forward from the base of the air bladder, upon which the user's weight is superimposed during use. The air bladder may be fully inflated, partially inflated or fully deflated as desired by the user, to incline the head or the head and torso, depending upon the size of the air bladder, of the user to the desired position.

The U.S. Pat. No. 5,387,166 patent discloses a traction apparatus for treating vertebral problems, which comprises a tripod-type self-standing support having a block and tackle unit suspended from the tripod apex. The lower block includes a T-bar upon which triangular cushions are supported for location under the knees of a supine patient, and a torso encircling belt includes a strap passing through the patient's legs that if adjustable attachable to the lower block. The block and tackle tension member includes a tail passing from the upper block to the patient, thus permitting the patient to raise and lower the leg supporting cushions to adjust the degree of back tension being achieved. A lock mechanism mounted on the upper block permits automatic positioning of the degree of leg lift.

For background purposes and as indicative of the art to which the invention is related reference may be made to the remaining cited patents.

| Pat. No. | INVENTOR | ISSUED |
|---|---|---|
| 5,362,682 | Kornberg | 6 November 1994 |
| 5,378,045 | Siekman et al | 3 January 1995 |
| 5,485,856 | Buckland | 23 January 1996 |
| 5,496,239 | Kallman et al | 5 March 1996 |

DISCLOSURE OF THE INVENTION

The skeletal realignment system is specifically designed to alleviate back pains by the proper application of pressure against the misaligned skeletal system allowing for the natural realignment of the body.

In its most basic design the skeletal realignment system is comprised of:

a) A first implement comprising:
   (1) A vertical section having an upper edge and a lower edge.
   (2) An upper section having a first end and a second end. The first end commences from the upper edge of the vertical section, slopes downward from a horizontal reference at an angle Ø and terminates with the second end positioned on the same horizontal plane as the lower edge of the vertical section.

b) A second implement which is identical to the first implement. To utilize the skeletal realignment system, the first implement is placed upon a substantially flat surface with the vertical section facing in a first direction. The second implement is also placed upon the flat surface, alongside the first implement, with the vertical section displaced substantially 180 degrees from the vertical section of the first implement. Upon the upper sections of the first and second implements is longitudinally placed the hips and back of a human body.

The method by which the skeletal realignment system functions is two-fold, first, any weight present is removed from a person's skeletal system. Second, properly applied pressure is placed upon the misaligned skeletal system, thereby allowing for the natural realignment of the bones.

Some pain that people experience is caused from muscles being strained or stretched, thus causing swelling (edema) and inflammation. The resultant aches and pains can cause a person to be unable to straighten up or in some cases, numbness, 1loss of feeling and soreness will occur. As long as a person's skeletal system is misaligned, the muscles cannot relax, which can lead to spasm and inflammation. As the swelling and inflammation increase, the muscles are further restricted, which increases the pain associated with any movement. The pain, swelling, inflammation and and numbness are a symptom of a misaligned skeletal system, not the cause.

In view of the above disclosure, it is the primary object of the invention to provide a skeletal realignment system that is effective in treating lower and upper back pain. The system allows for the natural realignment of the skeletal system and the relief of pain.

In addition to the primary object of the invention, it also an object of the invention to produce a system that:

- is designed to cause muscles and bones to relax, thereby allowing pain and soreness to be relieved,
- can be used with no special medical or chiropractic training, in the convenience and privacy of a person's home,
- is economical from both a manufacturer's and consumer's point of view,
- can be easily stored when not in use, and transported to a different location when needed,
- offers an alternative to many other in-effective or even dangerous skeletal treatment methods.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
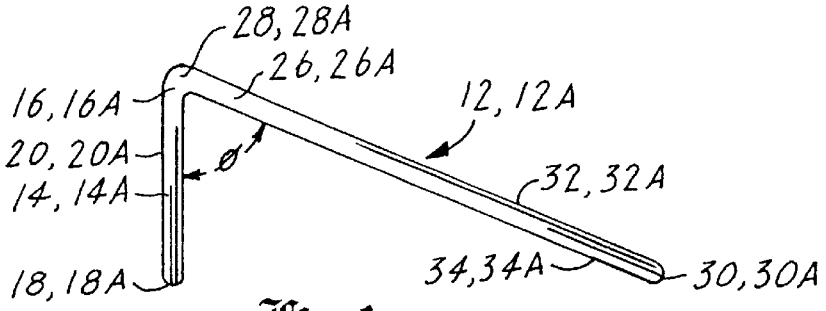
FIG. 1 is a side elevational view of a first and second implement which include a vertical section and an upper section that are integrally formed.

The best mode for carrying out the invention is presented in terms of a preferred embodiment which utilizes two identical implements to operate a skeletal realignment system. The realignment system allows an individual to quickly and easily relieve many back aches that are directly related to the misalignment of the back. Whenever a problem arises that is related to a person's upper or lower back it is often necessary for a trained professional, such as a chiropractor, to remedy the problem. The skeletal realignment system permits an individual to fix many of the back-related problems at their own leisure and in their own environment, thus saving valuable time and money otherwise spent on professional therapy.

The preferred embodiment of the skeletal realignment system 10, (hereinafter system 10), is shown in FIGS. 1–9 and is comprised of a first implement 12, an identical second implement 12A and an optional floor mat 74.

As stated above, the system 10 utilizes two implements that function in combination to produce the desired back realignment results. The first implement 12 of the system 10, is disclosed in four design configurations as shown in FIGS. 1–8, is comprised of a substantially vertical section 14, which has an upper edge 16, a lower edge 18, an outer surface 20, and an inner surface 22. The first implement 12 also has an upper section 26 that has a first end 28, a second 30, an upper surface 32 and a lower surface 34.

The first end 28 of the upper section 26 is attached by attachment means 36 to the upper edge 16 of the vertical section 14. In the first design configuration the attachment means 36 is an integrally formed attachment as shown in FIG. 1. When these two elements are attached, the upper section 26 is made to slope downward from a horizontal reference at an angle Ø, as shown in FIG. 1, and the second end 30 terminates on the same horizontal plane as the lower edge 18 of the vertical section 14.

The second implement 12A, as also shown in FIG. 1, is comprised of the same elements as the first 10 implement 12 including: a substantially vertical section 14A that has an upper edge 16A, a lower edge 18A, an outer surface 20A, and an inner surface 22A. The second implement 12A also has an upper section 26A having a first end 28A, a second end 30A, an upper surface 32A and a lower surface 34A.

As with the first implement 12, the first end 28A of the upper section 26A of the second implement 12A is integrally attached to the upper edge 16A of the vertical section 14A. when attached, the upper section 26A will slope downward from a horizontal reference at an angle Ø and the second end 30A will terminate on the same horizontal plane as the lower edge 18A of the vertical section 14A.

The preferred dimensions for the first and second implements 12,12A are as follows: each vertical section 14,14A has a width ranging from 3 inches to 6 inches (7.6 cm to 15.2 cm) with 5 inches (12.7 cm) being preferred, and a length ranging from 3 inches to 4 inches (7.6 cm to 10.2 cm), with 3.5 inches (8.9 cm) preferred. Each upper section 26,26A has a width ranging between 3 inches to 6 inches (7.6 cm to 15.2 cm), with 5 inches (12.7 cm) being preferred, and a length ranging from 9 inches to 11 inches (22.9 cm to 27.9 cm), with 10 inches (25.4 cm) preferred. The angles Ø has a slope ranging from 10 to 15 degrees, with a slope of 12 degrees preferred.

Figure 4:
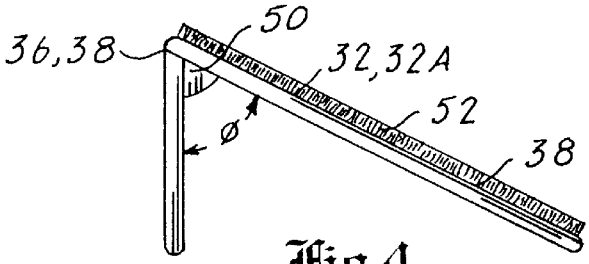
FIG. 4 is a side elevational view of a first and second implement that are made in two sections that are joined by an adhesive and which further includes a gusset to increase the strength of the joint. The figure also shows a non-slip material attached to the upper surface of the upper section.
Figure 2:
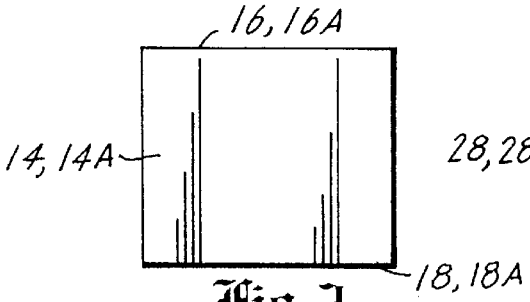
FIG. 2 is a front elevational view thereof.
Figure 3:
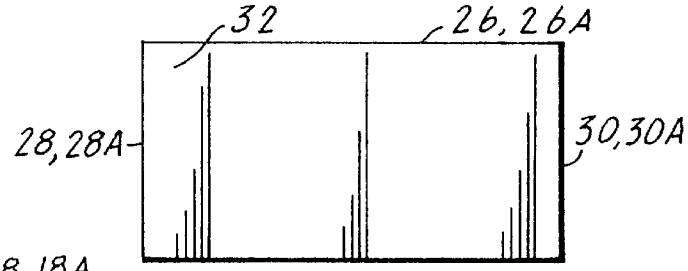
FIG. 3 is a top plan view thereof.
Figure 6:
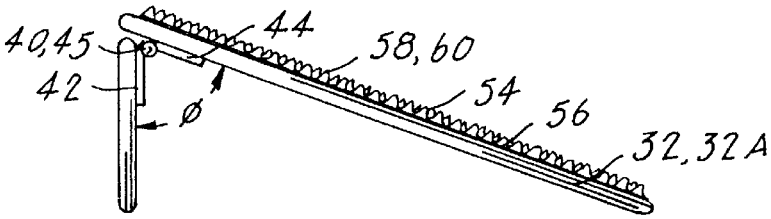
FIG. 6 is a side elevational view of a vertical section that is attached to an upper section by a hinge having a locking mechanism that locks the two sections at the proper angle for use. The figure also shows a resilient material attached to the upper surface of the upper section.
Figure 7:
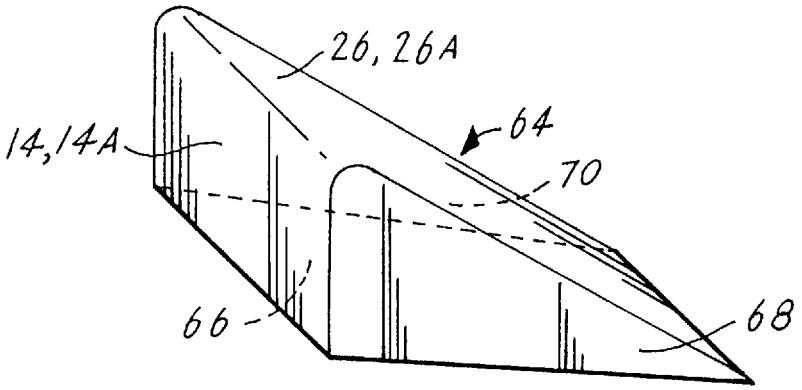
FIG. 7 is a perspective view of a first and second implement that is molded to produce an enclosed hollow structure.

In lieu of the integrally formed first and second implements, as shown in FIG. 1, three other methods for attaching the upper section to the vertical section may be utilized as shown in FIGS. 4, 6 and 7.

The second attachment means 36 utilizes an adhesive 38, as shown in FIG. 4, to attach the upper section 26 or 26A to the vertical section 14 or 14A. To increase the structural integrity of the adhesive bond, a gusset 50 may be utilized., The gusset 50, as shown in FIG. 4, is attached by an adhesive at the apex of the angle Ø.

Figure 5:
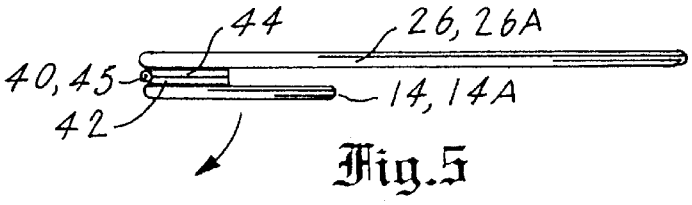
FIG. 5 is aside elevational view of a vertical section that is attached to an upper section by means of a hinge that allows the vertical section to fold against the upper section for storage.

The third attachment method utilizes a continuous hinge 40, as shown in FIGS. 5 and 6, to attach the upper sections 26 or 26A to the vertical sections 14 or 14A. The continuous hinge 40 has a first leaf 42 that is attached to the vertical section 14 or 14A and a second leaf 44 that is attached to the upper section 26 or 26*a*. The hinge 40 has two functional positions: a first position which allows the vertical section 14 or 14A to fold inward, with the inner surface 22 or 22A juxtaposed against the lower surface 34 or 34A of the upper section 26 or 26*a*. A second position, which utilizes a hinge that incorporates a locking mechanism 45, as shown in FIG. 6, that when manually set causes the upper section 26 or 26A to be locked in a position which allows the second end 30 or 30A to terminate on the same horizontal plane as the lower edge 18 or 18A of the vertical section 14 or 14A.

Figure 8:
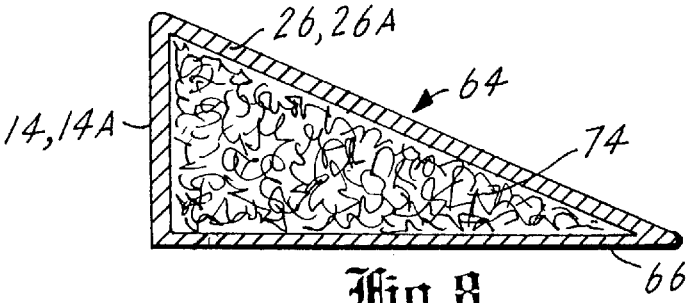
FIG. 8 is an enclosed hollow sectional side view of a first and second implement having an opening into which is blown a quantity of foam that when set adds to the structural integrity of the implements.
Figure 9:
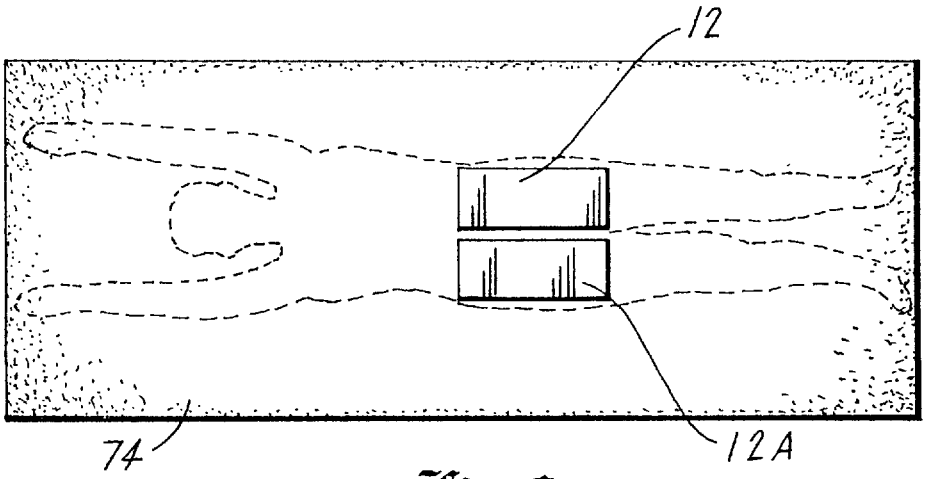
FIG. 9 is a top plan view of a flat mat that has imprinted thereon a pair of templates corresponding to the correct placement of the first and second implements.

In the fourth attachment method, both the first 12 and second 12A implements are molded from a plastic material to produce a hollow structure 64, which is enclosed by each respective vertical section 14 or 14A, each upper section 26 or 26A, a lower section 66, a first side 68, and a second side 70. As shown in FIGS. 7 and 8, the hollow structure 64 has an opening 72 on the lower section 66. A quantity of foam, such as a urethane foam 74, is blown into the opening 72 with the aid of a catalyst and blowing agents to add structural integrity to each of the implements 12,12A.

To add further utility to the system 10, a non-slip material 52, such as a soft, grained plastic or rubber based material, as shown in FIG. 4, is attached by an adhesive 38 to the upper surface 32 or 32A of the upper section 26 or 26A. Alternatively, a resilient material 54, such as rubber, as shown in FIG. 6, that has a lower adhesive surface 56 and an upper surface 58, itself having a multiplicity of resilient acupressure protrusions 60 is attached, via the adhesive surface 56, to the upper surface 32 or 32A of the upper section 26 or 26A.

To assist in the correct placement of the system 10 during use, a floor mat 74 having imprinted thereon a pair of templates 76 corresponding to the proper placement of the first and second implements 12 or 12A is utilized.

To use the skeletal realignment system 10, a simple process is undertaken that includes the following steps.

a) locate a substantially flat surface which has sufficient space to allow the human body to lie down and stretch lengthwise and sideways, b) place the first implement 12 with the lower edge 18 of the vertical section 14 resting on the flat surface and the second end 30 of the upper section 26 facing a first direction, c) place the second implement 12A with the lower edge 18A of the vertical section 14A resting on the flat surface and rotated 180 degrees from the vertical section 14 of the first implement 12 so that the second end 30A of the upper section 26A faces a second direction, d) laterally separate the first and second implements 12 and 12A to correspond with the width of the hips, e) position the body upon the first and second implements 12 and 12A so that the hip joint is substantially three-fourths up from the second end 30 of the upper section 26 of the first implement 12, once in position:

(1) place the arms above the head, (2) place the feet together at the ankles with the heels touching, (3) stretch and arch the back to allow the lower back to be slightly raised— hold this position for one to three minutes, (4) repeat step (3) until the hips and back are realigned, and f) after the hips and back have been realigned, carefully roll off the first and second implements and balance the body on both arms and knees, before rising to a standing position.

To further assist in the correct placement of the first and second implements when performing the above process, the flat surface may consist of the floor mat 74. As previously described, the mat 74 has imprinted thereon a pair of templets that correspond to the correct placement of the first and second implements 12 and 12A.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. A skeletal realignment system comprising:

a) a first implement comprising:

(1) a vertical section having an upper edge and a lower edge, (2) an upper section having a first end and a second end, wherein the first end commences from the upper edge of said vertical section, slopes downward from a horizontal reference at an angle Ø and terminates with the second end positioned on the same horizontal plane as the lower edge of said vertical section, b) a second implement comprising:

(1) a vertical section having an upper edge and a lower edge, (2) an upper section having a first end and a second end, wherein the first end commences from the upper edge of said vertical section, slopes downward from a horizontal reference at an angle Ø and terminates with the second end Positioned on the same horizontal plane as the lower edge of said vertical section, wherein said vertical sections have a width ranging from 3 inches to 6 inches (7.6 cm to 15.2 cm) with 5 inches (12.7 cm) preferred, and a length ranging from 3 inches to 4 inches (7.16 cm to 10.2 cm) with 3.5 inches (8.9 cm) preferred; wherein said upper sections have a width ranging between 3 inches to 6 inches (7.6 cm to 15 cm) with 5 inches (12.7 cm) preferred and a length ranging from 9 inches to 11 inches (22.9 cm to 27.9 cm) with 10 inches (25.4 cm) preferred, and wherein the angle Ø has a slope ranging from 10 to 15 degrees with a slope of 12 degrees preferred, wherein to utilize said skeletal realignment system, said first implement is placed upon a substantially flat surface with said vertical section facing in a first direction and said second implement is also placed upon the flat surface, alongside said first implement, with said vertical section displaced substantially 180 degrees from said vertical section of said first implement. whereupon the upper sections of said first and second implements is longitudinally placed the hips and back of a human body.

2. The system as specified in claim 1 further comprising a floor mat having imprinted thereon a pair of templates corresponding to the correct placement of said first and second implements.

3. A skeletal realignment system comprising:

a) a first implement comprising:

(1) a substantially vertical section having an upper edge a lower edge, an outer surface and an inner surface, (2) an upper section having a first end, a second end, an upper surface and a lower surface, wherein the first end is attached, to the upper edge of said vertical section, wherein when attached, the upper section slopes downward from a horizontal reference at an angle Ø and the second end terminates on the same horizontal plane as the lower edge of said vertical section, b) a second implement comprising:

(1) a substantially vertical section having an upper edge, a lower edge, an outer surface and an inner surface, an upper section having a first end, (2) a second end, an upper surface and a lower surface, wherein the first end is attached, to the upper edge of said vertical section, wherein when attached, the upper section slopes downward from a horizontal reference at an angle Ø and the second end terminates on the same horizontal plane as the lower edge of said vertical section, wherein said upper sections are attached to said vertical sections by means of a continuous hinge having a first leaf that is attached to the vertical section and a second leaf that is attached to the horizontal section, wherein said hinge has two functional positions:

a first position which allows said vertical section to fold inward with the inward surface juxtaposed against the lower surface of said upper section and a second position, which utilizes a hinge that incorporates a locking mechanism that when manually set, the upper section is locked in a position which allows the second end to terminate on the same horizontal plane as the lower edge of said vertical section, wherein to utilize said skeletal realignment system said first implement is placed upon a substantially flat surface with said vertical section facing in a first direction and said second implement is also Placed upon the flat surface, alongside said first implement, with said vertical section displaced substantially 180 degrees from said vertical section of said first implement, whereupon the upper sections of said first and second implements is longitudinally placed the hips and back of a human body.

4. The system as specified in claim 3 wherein said vertical section has a width ranging from 3 inches to 6 inches (7.6 cm to 15.2 cm) with 5 inches (12.7 cm) preferred, and a length ranging from 3 inches to 4 inches (7.16 cm to 10.2 cm) with 3.5 inches (8.9 cm) preferred; on the upper section has a width ranging between 3 inches to 6 inches (7.6 cm to 15.2 cm) with 5 inches (12.7 cm) preferred and a length ranging from 9 inches to 11 inches (22.9 cm to 27.9 cm) with 10 inches (25.4 cm) preferred, and wherein the angle Ø has a slope ranging from 10 to 15 degrees with a slope of 12 degrees preferred.

5. The system as specified in claim 4 further comprising a gusset attached by an adhesive at the apex of the angle Ø.

6. The system as specified in claim 3 further comprising a non-slip material that is attached by an adhesive to the upper surface of said upper section.

7. The system as specified in claim 3 further comprising a resilient material having a lower adhesive surface and an upper surface having a multiplicity of resilient acupressure protrusions, wherein the adhesive surface is attached to the upper surface of said upper section.

8. The system as specified in claim 3 further comprising a floor mat having imprinted thereon a pair of templates corresponding to the correct placement of said first and second implements.

9. A skeletal realignment system comprising:

a) first implement comprising:

(1) a vertical section having an upper edge, a lower edge, (2) an upper section having a first end, and a second end, wherein the first end commences from the upper edge of said vertical section, slopes downward from a horizontal reference at an angle Ø and terminates with the second end positioned on the same horizontal plane as the lower edge of said vertical section, b) a second implement comprising:

(1) a vertical section having an upper edge, a lower edge, (2) an upper section having a first end and a second end, wherein the first end commences from the upper edge of said vertical section, slopes downward from a horizontal reference at an angle Ø and terminates with the second end positioned on the same horizontal plane as the lower edge of said vertical section wherein said first and second implements are molded from a plastic material to produce a hollow structure which is enclosed by the vertical section, the upper section, a lower section, a first side and a second side, wherein said hollow structure having an opening on the lower section where into said opening is inserted a quantity of a foam wherein said foam which adds structural integrity to said first and second implements, wherein to utilize said skeletal realignment system, said first implement is placed upon a substantially flat surface with said vertical section facing in a first direction and said second implement is also placed upon the flat surface, alongside said first implement, with said vertical section displaced substantially 180 degrees from said vertical section of said first implement, whereupon the upper sections of said first and second implements is longitudinally placed the hips and back of a human body.

10. The system as specified in claim 9 further comprising a floor mat having imprinted thereon a pair of templates corresponding to the correct placement of said first and second implements.

11. A process for realigning the human back by utilizing a first implement in combination with a second implement, wherein said process comprises the following steps:

a) locate a substantially flat surface which has sufficient space to allow the human body to lie down and stretch lengthwise and sideways, b) Place said first implement with the lower edge of the vertical section resting on the flat surface and the second end of the upper section facing a first direction, c) place said second implement with the lower edge of the vertical section resting on the flat surface and rotated 180 degrees from the vertical section of the first implement so that the second end of the upper section faces a second direction, d) laterally separate the first and second implements to correspond with the width of the hips, e) position the body upon the first and second implements so that the hip joint is substantially three-fourths up from the second end of the upper section of said first implement, once in position:

(1) place the arms above the head, (2) place the feet together at the ankles with the heels touching, (3) stretch and arch the back to allow the lower back to be slightly raised— hold this position for one to three minutes, (4) repeat step (3) until the hips and back are realigned, and f) after the hips and back have been realigned, carefully roll off said first and second implements and balance the body on both arms and knees, before rising to a standing position.

12. The process as specified in claim 11 wherein said flat surface is comprised of a floor mat having imprinted thereon a pair of templates corresponding to the correct placement said first and second implements.

* * * * *